US009062870B2

(12) United States Patent
Hoang

(10) Patent No.: US 9,062,870 B2
(45) Date of Patent: Jun. 23, 2015

(54) UV BULB CONFIGURATION

(71) Applicant: Caldesso, LLC, Lake Forrest, IL (US)

(72) Inventor: Bui Hoang, Jurupa Valley, CA (US)

(73) Assignee: Caldesso, LLC, Lake Forrest, IL (US)

( * ) Notice: Subject to any disclaimer, the term of this patent is extended or adjusted under 35 U.S.C. 154(b) by 0 days.

(21) Appl. No.: 14/275,739

(22) Filed: May 12, 2014

(65) Prior Publication Data

US 2014/0333196 A1 Nov. 13, 2014

Related U.S. Application Data

(60) Provisional application No. 61/822,247, filed on May 10, 2013.

(51) Int. Cl.

| | |
|---|---|
| ***H01J 5/48*** | (2006.01) |
| ***H01J 5/50*** | (2006.01) |
| ***F21V 23/06*** | (2006.01) |

(52) U.S. Cl.

CPC ..... *F21V 23/06* (2013.01)

(58) Field of Classification Search

CPC ..... H01L 2924/00; H01L 21/4853; H01L 21/4889; H01L 2224/4824; H01L 2224/851; H01L 2924/15312; H01J 5/50; H01K 1/44; H01K 1/46; H01K 1/24; H01K 1/465; H05K 2201/1031; F21V 17/14; F21V 19/009

USPC ..... D13/134, 136

See application file for complete search history.

(56) References Cited

U.S. PATENT DOCUMENTS

| | | | | |
|---|---|---|---|---|
| 4,256,989 | A * | 3/1981 | Trutner et al. | 313/318.01 |
| D292,320 | S | 10/1987 | Futatsugi et al. | |
| 4,700,101 | A * | 10/1987 | Ellner et al. | 313/1 |
| 4,713,019 | A | 12/1987 | Gaynor | |
| 4,738,630 | A | 4/1988 | Wittmann | |
| D303,297 | S | 9/1989 | Sangen et al. | |
| D304,030 | S | 10/1989 | Vakil | |
| 4,891,558 | A | 1/1990 | Tschuk | |
| 4,912,360 | A | 3/1990 | Meyer | |
| 5,166,527 | A * | 11/1992 | Solymar | 250/436 |
| 5,422,487 | A * | 6/1995 | Sauska et al. | 250/436 |
| D397,811 | S | 9/1998 | Vakil | |
| 5,990,610 | A | 11/1999 | Matsumoto et al. | |
| 6,124,673 | A | 9/2000 | Bishop | |
| 6,250,947 | B1 | 6/2001 | Holzer | |
| 6,692,309 | B1 | 2/2004 | Kovacs | |
| 6,812,639 | B2 | 11/2004 | Ward et al. | |
| 6,884,103 | B1 | 4/2005 | Kovacs | |
| 7,390,222 | B2 * | 6/2008 | Ciancanelli et al. | 439/617 |
| D575,742 | S | 8/2008 | Scherer et al. | |

(Continued)

FOREIGN PATENT DOCUMENTS

| | | |
|---|---|---|
| WO | WO 2006/136026 | 12/2006 |
| WO | WO 2008/101182 | 8/2008 |

*Primary Examiner* — Donald Raleigh

(74) *Attorney, Agent, or Firm* — Knobbe Martens Olson & Bear LLP

(57) ABSTRACT

A UV light and socket assembly having a pin and hole arrangement with a central pin and corresponding hole with peripheral pins and corresponding holes arranged approximately 120 degrees from each other from the central pin and opening. The light and socket assembly including a locating projection and corresponding locating opening that receives the projection that is positioned so as to be aligned with one of the peripheral pin and openings and the central pin and opening.

9 Claims, 4 Drawing Sheets

(56) References Cited

U.S. PATENT DOCUMENTS

| | | | | |
|---|---|---|---|---|
| D585,377 | S | 1/2009 | Zayas | |
| D591,238 | S | 4/2009 | Scherer et al. | |
| D593,706 | S | 6/2009 | Zayas et al. | |
| 7,569,981 | B1 | 8/2009 | Ciancanelli | |
| 7,795,813 | B2 | 9/2010 | Zayas | |
| 8,021,189 | B2 | 9/2011 | Zayas et al. | |
| 2007/0298639 | A1* | 12/2007 | Elku et al. | 439/220 |
| 2008/0182454 | A1* | 7/2008 | Zayas | 439/617 |
| 2008/0182455 | A1* | 7/2008 | Elku et al. | 439/617 |
| 2008/0188131 | A1* | 8/2008 | Zayas | 439/617 |
| 2009/0156037 | A1 | 6/2009 | Zayas et al. | |
| 2010/0015843 | A1 | 1/2010 | Zayas et al. | |
| 2010/0085505 | A1* | 4/2010 | Kitagawa et al. | 349/61 |
| 2011/0227473 | A1* | 9/2011 | Elku et al. | 313/243 |

* cited by examiner

UV BULB CONFIGURATION

PRIOR APPLICATIONS

This application claims the benefit of U.S. Provisional Application No. 61/822,247 filed May 10, 2013 entitled UV BULB CONFIGURATION which is hereby incorporated by reference in its' entirety.

BACKGROUND OF THE INVENTION

1. Field of the Invention

The present invention relates to UV bulbs and sockets and, in particular, concerns a UV bulb configuration that is easy to assembly and is securely retained.

2. Description of the Related Art

UV light sources are commonly used in many different applications including disinfecting water and the like. Generally, the light source includes a sealed tube that contains the UV element and the UV element is attached to a base that has pins. The pins are then inserted into a socket mounted in a frame of the device using the UV light source. Power is then supplied to the socket having openings that receive the pins which then powers the UV light source. The location of the pins and openings can, of course, be switched between bulb and socket.

One difficulty that occurs with UV light sources is that there can be misalignment of the pins of the UV bulb assembly and the openings in the socket that receive the UV bulb assembly. To address this issue, various different pin configurations have been developed such as those disclosed in U.S. Pat. No. 7,604,505 to Zayas and assigned to Light Sources Inc. In this patent, the pins and openings are formed on different levels which require correct orientation of the bulb with respect to the sockets for correct insertion.

While this configuration can address the issue of misalignment of the pins and openings, it is difficult to assembly and requires additional material. Moreover, the raised levels are formed of ceramic material which increases the potential of the elements breaking and thus ruining the bulb or socket.

Hence, there is a continuing need for a UV bulb and socket assembly that inhibits misalignment but does not have an increased risk of breakage.

SUMMARY OF THE INVENTION

The aforementioned needs are satisfied by the design of the present invention which, in one aspect, comprises a UV light assembly having a socket having a circular face with a central opening located at substantially the axis of the circular face. The socket includes peripheral openings that are located adjacent the outer circumference of the circular central face at approximately 120 degree intervals. A locating opening is also formed at the outer circumference of the circular face of the socket. The assembly further comprises a UV light bulb that has a base with circular face of substantially the same dimensions as the circular face of the socket with four pins extending outward therefrom. The pins include a centrally located pin located at substantially the axis of the circular face so as to mate with the central opening in the socket. The socket further includes peripheral pins that are located adjacent the outer circumference of the circular central face at approximately 120 degree intervals to be inserted into the peripheral openings located at 120 degree intervals of the circular face of the socket. The circular face of the base also includes a locating protrusion that is located adjacent the outer periphery of the circular face and is dimensioned so as to fit into the locating opening formed in the outer periphery of the circular face of the socket.

The use of a central pin and opening combined with peripheral pins and openings that are evenly spaced about the faces of the socket and base of the UV light bulb creates a strong force between the bulb and socket. The use of a single peripheral locating protrusion and opening further prevents misalignment. As the circular faces are planar, the risk of damage to the base and socket is reduced. Indeed, the only protrusion that extends outward that has a greater risk of breakage is the locating protrusion which wouldn't prevent the light bulb from being used.

These and other objects and advantages of the present invention will become more apparent from the following description taken in conjunction with the accompanying drawings.

DETAILED DESCRIPTION OF ONE EMBODIMENT

Figure 1:
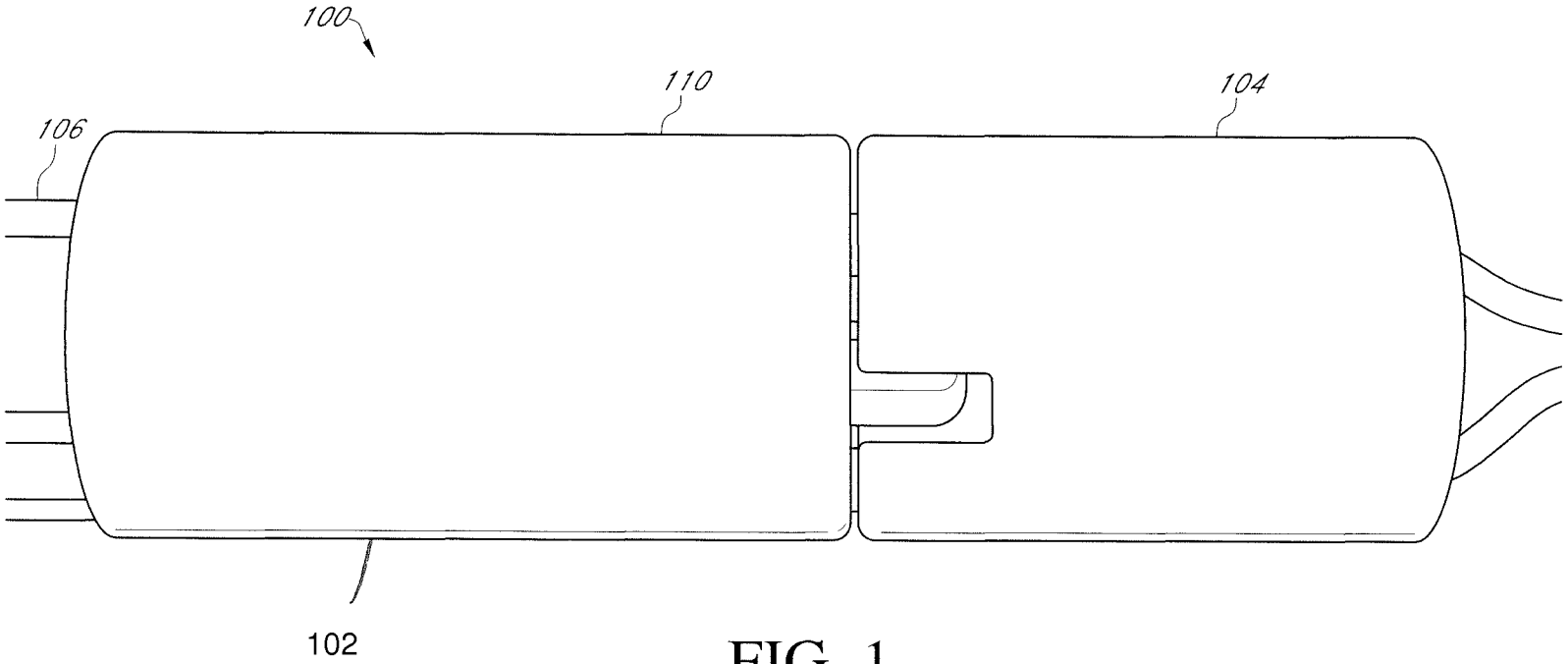
FIG. 1 is an assembled view of a UV light socket and bulb in a connected configuration.
Figure 2:
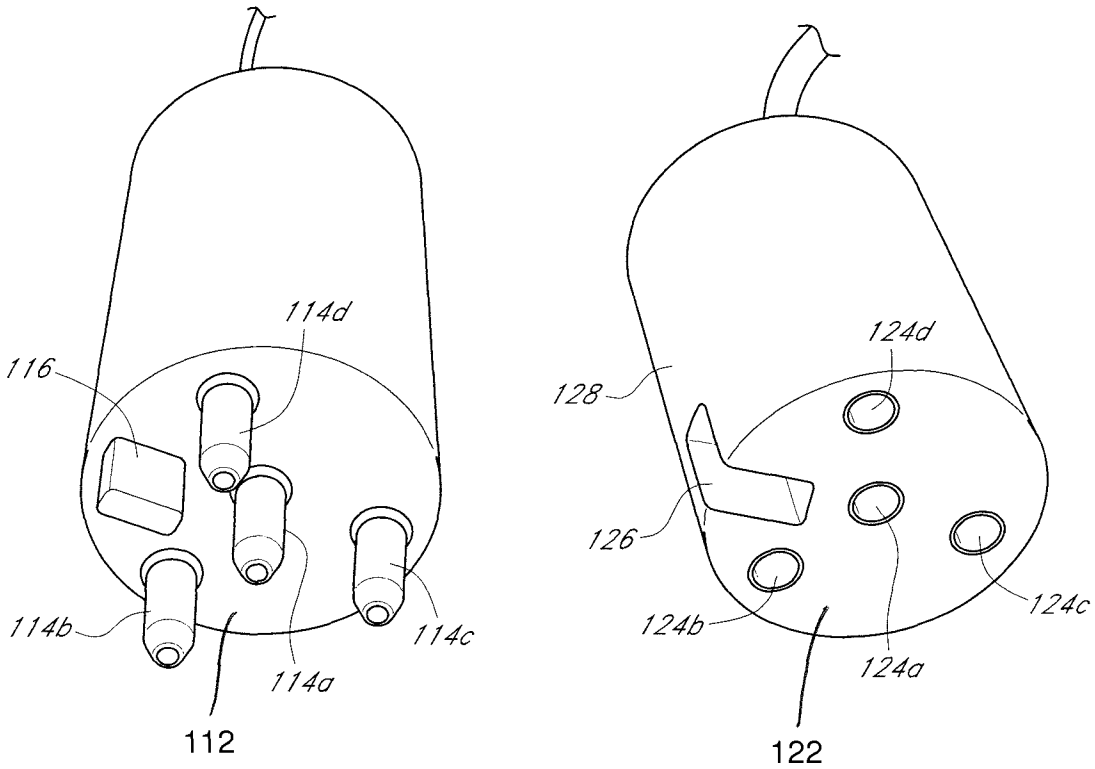
FIG. 2 is a disassembled view of the UV light socket and bulb of FIG. 1.
Figure 3A:
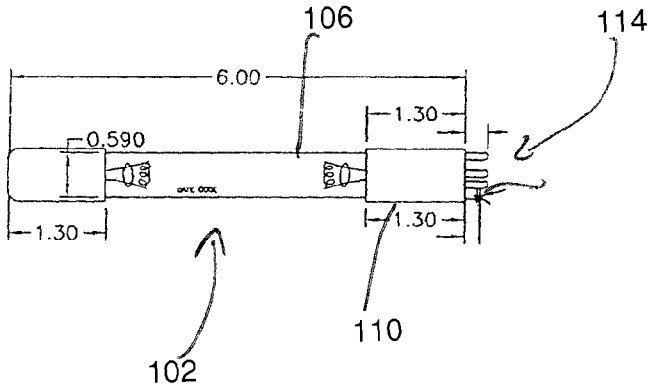
FIGS. 3A-3C are detailed views of the UV light bulb and connection assembly of the UV light socket and bulb of FIG. 1.

Reference will now be made to the drawings, wherein like numerals refer to like parts throughout. Referring initially to FIG. 1, an assembly 100 comprising a UV light bulb 102 and a socket 104 is shown. The UV light bulb 102 includes a glass tube 106 that contains a UV radiation source that radiates UV energy when the source receives power. The UV bulb is also shown in FIG. 3A. The UV light bulb 102 also includes a cylindrical base 110 that is generally circular in dimension. The cylindrical base 110 is preferably made of ceramic and provides insulation to the pins and conductors positioned therein. The UV light bulb 102 and the socket 104 mate with each other in the manner shown in FIG. 1 so that electrical power is provided to the light via the socket 104. FIG. 2 shows the faces of the light 102 and the socket 104 in greater detail and will also be described in greater detail below.

More specifically, as shown in FIGS. 2 and 3A-3C, the base 110 has a circular face 112 that has a central pin 114*a* and three peripheral pins 114*b-d*. The central pin 114*a* is located at substantially the axis of the circular face 112. The peripheral pins 114*b-d* are located adjacent the outer circumference of the circular face 112 and are located approximately 120 degrees from each other. The circular face 112 also includes a locating protrusion 116 that is also located adjacent the outer circumference of the face 112.

Figure 3B:
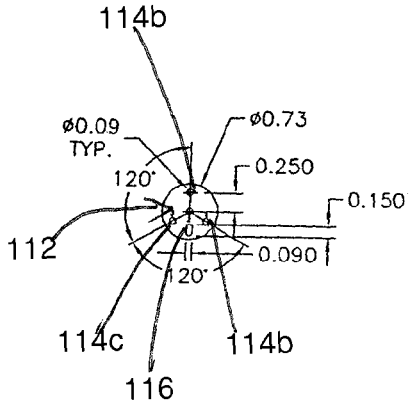
Figure 3C:
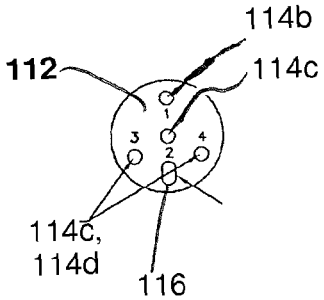

As shown in FIGS. 2 and 3B, the socket 104 has a circular face 122 that has a central opening 124*a* and three peripheral openings 124*b-d*. The central opening 124*a* is located at substantially the axis of the circular face 122. The peripheral openings 124*b-d* are located adjacent the outer circumference of the circular face 122 and are located approximately 120 degrees from each other. The circular face 122 also includes a locating opening 126 that is also located adjacent the outer circumference of the face 122.

As shown in FIG. 1, the openings 124*a-d* of the socket 104 receive the pins 114*a-d* of the base 110 of the light bulb 102 to power the light bulb 102. The openings 124*a-d* of the socket 104 also includes metal contacts 125*a-d* that engage with the pins 114*a-d* to provide electrical contact therebetween. The locating protrusion 116 is also received in the locating opening 126 to prevent misalignment of the pins. Both the locating protrusion 116 and the locating opening 126 are positioned about the periphery of the faces 112, 122 so as to be aligned with the central pin 114*a* or opening 124*a* and a peripheral pin 114*b* or opening 124*b*. Hence, the locating protrusion 116 and opening 126 are located approximately 60 degrees offset from each of the surrounding pins 114 and openings 124.

As shown in the Figures, the locating opening 126 is open on the circular face 122 of the socket 104 and also is open along a side wall 128 of the socket 104. This reduces the frictional engagement between the locating protrusion 116 and the opening 126. As is also shown, the protrusion 116 and opening 126 extend radially outward. In one specific implementation, the circular faces 112, 122 are 0.73 or 0.728 inches in diameter and the protrusion 116 is approximately 0.150 inches long and 0.090 inches wide and extends out approximately 0.200 inches from the face 112 of the cylindrical base 110 of the light bulb 102. In another implementation, the protrusion is approximately 0.180 inches long extending radially outward on the surface 112, and is approximately 0.120 inches wide. The edges are radiused at 0.040 to 0.055 inches. The protrusion extends outward from the surface 112 a distance of approximately 0.20 inches. The pins 114*a*-114*d* are approximately 0.09 inches in diameter and extend outward from the face approximately 0.3 inches. The opening 126 has corresponding dimensions and the base is preferably made of ceramic or other equivalent material.

Figure 4A:
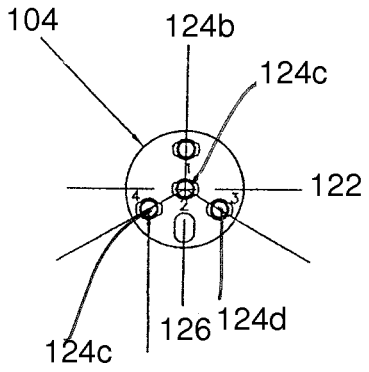
FIGS. 4A-4C are detailed views of the socket of the UV light socket and bulb of FIG. 1.

The socket 104 is dimensioned to receive the pins 114 and protrusion 116. As shown in FIGS. 4A and 5A, the opening 126 is typically 0.180 inches long, 0.120 inches wide and 0.3 inches deep. Thus, the dimensions of the opening 126 is greater than the dimensions of the protrusion 116 to facilitate the protrusion being positioned within the opening 126. As is also discussed above, the side wall of the opening 126 is open which further facilitates positioning of the protrusion 116 within the opening 126.

Figure 4B:
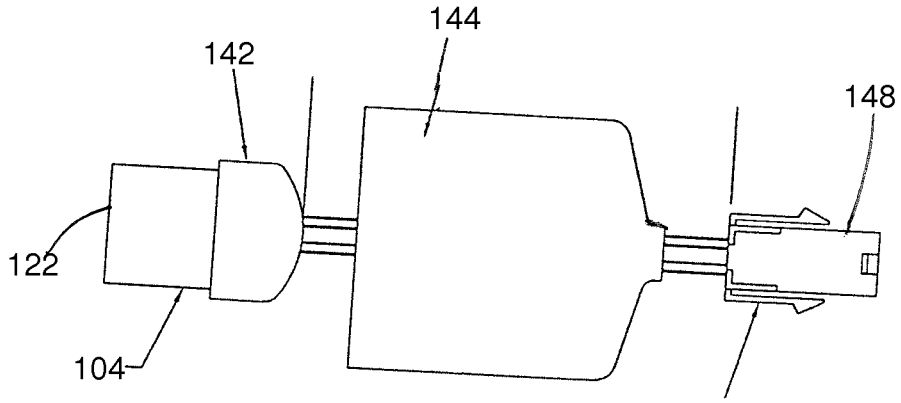
Figure 4C:
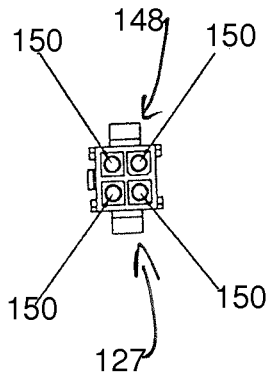

FIGS. 4B and 4C illustrate additional components of a socket assembly 140 that provides power to the light bulb 102. As shown, there is the socket 104 that is preferably made of ceramic and has a cushion 142 positioned on the end 127 opposite the face 122. Wires 142 extend out of the end opposite the face 122 and into the cover 144 that receives the socket 104. The cover 144 is preferably made of a resilient material, such as rubber and the like, and secures the socket 104 and the light bulb 106 in a known manner. The wires then extend into a connector 148 that has pin openings 150 (FIG. 5C) to permit the socket 104 to be connected to a power supply. The connector 148 can be any of a number of standard connectors known in the art.

FIG. 5C illustrates the end 127 of the socket 104 from which the wires 142 protrude. As shown, there are a plurality of holes that align with the openings 124*a-d* from which the wires extend outward. The wires 142 are preferably electrically coupled to the contacts 125*a-d* in the interior of the socket 104 in a manner known in the art.

Although the foregoing discussion has shown, illustrated and described one embodiment of the present invention, it will be apparent that various changes, modifications and alternative uses to the disclosed embodiment may be made by those skilled in the art without departing from the spirit and scope of the present invention. Hence, the present invention should not be limited to the foregoing discussion but should be defined by the appended claims.

What is claimed is:

1. A UV light and socket assembly comprising:

a UV light having an end casing with an circular end face, wherein the UV light has four pins, with a first pin located at a central axis of the end face and the remaining three pins being positioned about the periphery of the end face spaced approximately 120 degrees from each other wherein the end face includes a projection that is aligned with a line that extends through one of the peripheral pins and the central pin; and a socket that has an end face with four pin openings positioned to receive the four pins and a projection opening that is positioned to receive the projection.

2. The assembly of claim 1, wherein the four pin openings includes a central opening and three peripheral openings and wherein the pin openings are spaced about the periphery of the end face of the socket approximately 120 degrees from each other.

3. The assembly of claim 2, wherein the four pin openings and the projection opening are larger than the pins and the projection of the UV light.

4. The assembly of claim 3, wherein the circular faces are approximately 0.73 inches in diameter and the protrusion 116 is approximately 0.150 inches long and 0.090 inches wide and extends out approximately 0.200 inches from the face 112 of the cylindrical base 110 of the light bulb 102.

5. The assembly of claim 4, wherein protrusion opening is typically 0.180 inches long, 0.120 inches wide and 0.3 inches deep.

6. The assembly of claim 4, wherein the pins are approximately are approximately 0.09 inches in diameter and extend outward from the face approximately 0.3 inches.

7. The assembly of claim 1, wherein the socket has a side wall in addition to the end face and the projection opening is open on both the end face and the side wall.

8. The assembly of claim 1, further comprising a cushion positioned on the socket, a cover and a connection wherein a plurality of wires extends from a second face of the socket opposite the front face and are connected to the connector.

9. The assembly of claim 1, wherein the cushion is positioned over the second face of the socket and wherein the cover is also positioned over the second face and the cushion.

* * * * *